US008360738B2

(12) United States Patent
Van Den Wyngaert et al.

(10) Patent No.: US 8,360,738 B2
(45) Date of Patent: Jan. 29, 2013

(54) DEVICE FOR REGULATING THE OPERATING PRESSURE OF AN OIL-INJECTED COMPRESSOR INSTALLATION

(75) Inventors: Peter Van Den Wyngaert, Heist-op-den-Berg (BE); Ivo Daniëls, Boom (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 781 days.

(21) Appl. No.: 12/303,940

(22) PCT Filed: Mar. 21, 2007

(86) PCT No.: PCT/BE2007/000047

§ 371 (c)(1), (2), (4) Date: Dec. 8, 2008

(87) PCT Pub. No.: WO2007/140550

PCT Pub. Date: Dec. 13, 2007

(65) Prior Publication Data

US 2010/0166571 A1 Jul. 1, 2010

(30) Foreign Application Priority Data

Jun. 9, 2006 (BE) ..... 2006/0317

(51) Int. Cl.
*F04B 49/06* (2006.01)

(52) U.S. Cl. ..... 417/44.2; 417/53; 417/307

(58) Field of Classification Search ..... 417/44.2, 417/53, 1–45

See application file for complete search history.

(56) References Cited

U.S. PATENT DOCUMENTS

| | | | | |
|---|---|---|---|---|
| 3,860,363 | A * | 1/1975 | Silvern et al. | 417/12 |
| 5,050,112 | A * | 9/1991 | Hedglen et al. | 702/152 |
| 5,054,995 | A | 10/1991 | Haseley et al. | |
| 5,306,116 | A * | 4/1994 | Gunn et al. | 415/27 |
| 5,352,098 | A | 10/1994 | Hood | |
| 5,388,968 | A * | 2/1995 | Wood et al. | 417/295 |
| 6,082,971 | A | 7/2000 | Gunn et al. | |
| 6,146,100 | A | 11/2000 | Broucke | |
| 6,419,454 | B1 * | 7/2002 | Christiansen | 417/4 |
| 7,094,019 | B1 * | 8/2006 | Shapiro | 415/27 |
| 2001/0046443 | A1 * | 11/2001 | Van De Putte | 417/44.2 |
| 2003/0223883 | A1 * | 12/2003 | Weber et al. | 417/213 |
| 2005/0053483 | A1 * | 3/2005 | Iimura et al. | 417/321 |
| 2007/0065302 | A1 * | 3/2007 | Schmitz | 417/298 |

FOREIGN PATENT DOCUMENTS

| | | |
|---|---|---|
| BE | 1 012 655 A3 | 2/2001 |
| EP | 0 942 173 A1 | 9/1999 |
| EP | 1 128 067 A1 | 8/2001 |

(Continued)

*Primary Examiner* — Mariceli Santiago
*Assistant Examiner* — Donald Raleigh
(74) *Attorney, Agent, or Firm* — Bacon & Thomas, PLLC

(57) ABSTRACT

Device for adjusting the operating pressure of an oil-injected compressor installation with a compressor element (2) driven by a motor (4) with an adjustable rotational speed and a control module (13), where the device (15) is provided with a controlled inlet valve (16) which is connected to the air inlet (5) and a blow-off mechanism (17) which can be closed by means of a blow-off valve (19), where the inlet valve (16), the blow-off valve (19) and the control module (13) are electrically controllable components which are connected to an electronic control unit (22) for adjusting the operating pressure (Pw), which is measured by an operating pressure sensor (23).

12 Claims, 4 Drawing Sheets

FOREIGN PATENT DOCUMENTS

| | | | |
|---|---|---|---|
| JP | 58 140498 | A | 8/1983 |
| JP | 2001 073956 | A | 3/2001 |
| WO | WO 99/17178 | A | 4/1999 |
| WO | WO 2005/038258 | A1 | 4/2005 |

* cited by examiner

DEVICE FOR REGULATING THE OPERATING PRESSURE OF AN OIL-INJECTED COMPRESSOR INSTALLATION

BACKGROUND

A. Field

The present invention concerns a device for adjusting the operating pressure of an oil-injected compressor installation.

B. Related Art

From EP 0.942.173 in the name of the same applicant is already known a device for adjusting the operating pressure of an oil-injected compressor installation which is provided with a compressor element that is driven by a motor with an adjustable rotational speed, controlled by a control module, whereby said compressor element is provided with an air inlet and with a compressed air outlet onto which is connected an oil separator with a compressed air pipe for supplying compressed gas, whereby the device is provided with a controlled inlet valve which is connected to the above-mentioned air inlet and a blow-off mechanism with a blow-off pipe connecting the oil separator to the inlet valve and which can be closed off by means of a blow-off valve.

In such a known device, the inlet valve of the compressor element is pneumatically controlled.

A disadvantage of such a pneumatic control system is that there is a continuous loss of compressed air, which is necessary for the good operation of such a control system.

Another disadvantage of such known pneumatic control systems is that the operating pressure of the compressor installation is always higher when it is unloaded than when it is loaded, as a result of which the operating pressure requires more power from the engine when the compressor installation is unloaded.

Another disadvantage of the known pneumatic control systems is that the regulating pressure pipes and air chambers create large time constants, such that in case of sudden fluctuations in the outlet flow of the compressor installation, there will be "overshoots" or "undershoots" in the operating pressure, whereby this operating pressure will suddenly represent a very high or very low value respectively.

A disadvantage connected thereto is that when the dimensions of the regulating pressure pipes are altered, for example due to a replacement or a repair, the above-mentioned time constants will assume a different value, which is disadvantageous to the stability of the adjustment.

An additional disadvantage of the known devices is that condensate may be formed in the regulating pressure pipes of the pneumatic control system which is discharged via air holes while the installation is operational, but which, after the compressor installation has been turned off, remains in the pipes and may accumulate there.

Also, in case of temperatures below zero, the regulating pressure pipes may freeze up and thus prevent the good working order of the pneumatic control system.

Another additional disadvantage is that with the known devices, the required operating pressure is set manually by screwing down a pneumatic regulating valve. Moreover, it can only be set when the compressor installation is operational.

Another disadvantage of the known devices is that the inlet valve usually has the shape of a piston valve which is disadvantageous in that its design causes large inlet losses.

BRIEF SUMMARY OF THE DISCLOSURE

The present invention aims to remedy one or several of the above-mentioned and other disadvantages.

To this end, the invention concerns a device for adjusting the operating pressure of an oil-injected compressor installation which is provided with a compressor element that is driven by a motor with an adjustable rotational speed, controlled by a control module, whereby this compressor element is provided with an air inlet and with a compressed air outlet onto which is connected an oil separator with a compressed air pipe for supplying compressed gas, whereby the device is provided with a controlled inlet valve which is connected to the above-mentioned air inlet and a blow-off mechanism with a blow-off pipe which connects the oil separator to the inlet valve and which can be closed off by means of a blow-off valve, whereby the device is characterised in that the above-mentioned inlet valve, the blow-off valve as well as the control module are electrically controllable components which are connected to an electronic control unit for adjusting the operating pressure in the oil separator, which is measured by an operating pressure sensor that is connected to this electronic control unit as well; in that the inlet valve is made in the shape of a butterfly valve that is driven by a stepping motor with an accompanying electronic stepping motor card; in that the above-mentioned electronic stepping motor card has a micro step modus; and in that the above-mentioned control unit is provided with an operating pressure controller which is made in the shape of a PID controller whose output signal represents the desired inlet flow of the compressor element, on the basis whereof the rotational speed of the motor, the inlet pressure at the air inlet and the exhaust flow through the blow-off valve are adjusted; whereby the control unit is further provided with an inlet pressure controller which is made in the shape of a PID controller with a reinforcement, whereby this reinforcement is a function of the position of the inlet valve or the relation between the absolute pressure following the inlet valve at the air inlet of the compressor element and the absolute pressure on the inlet side of the inlet valve.

An advantage of a device according to the invention is that the efficiency of the compressor installation is considerably improved, as there are no more losses of compressed air as is the case with a pneumatic control system.

Another advantage of a device according to the invention is that the operating pressure can be constantly maintained, when the compressor installation is loaded as well as when it is unloaded, which requires less power from the engine.

Another advantage of such a device according to the invention is that the time constants are considerably smaller than with the known regulating systems that are based on compressed air, as a result of which the device can react much faster to variations in the outlet flow of the compressor installation, resulting in smaller "overshoots" and "undershoots", and that the time constants can be much better controlled.

Another additional advantage of a device according to the invention is that the pneumatic regulating pressure pipes are omitted, as a result of which the freezing problems are restricted to the blow-off valve.

Another advantage of a device according to the invention is that the required operating pressure can be easily inputted via a control panel.

An additional advantage of a device according to the invention is that the electronic control system is more appropriate for additional functionalities such as for example inputting a required operating pressure from a distance by means of a remote control.

Still another advantage thereof is that such a butterfly valve causes considerably Less inlet losses than a piston valve that is applied in conventional pneumatic control systems. The non-linear operating characteristic of the butterfly valve can be easily realised in an electronic way.

In a preferred embodiment of a device according to the invention, the above-mentioned control unit is provided with an operating pressure controller made in the shape of a PID controller whose output signal represents the required outlet flow that sets the rotational speed of the motor, the inlet pressure at the air inlet and the exhaust flow through the blow-off valve.

The outlet flow is hereby the air mass flow through the compressed air pipe, whereas the exhaust flow is the air mass flow flowing through the blow-off valve.

DESCRIPTION OF THE DRAWINGS

In order to better explain the characteristics of the present invention, the following preferred embodiment of a control system according to the invention for an oil-injected compressor installation is given as an example only, without being limitative in any way, with reference to the accompanying drawings, in which.

DETAILED DESCRIPTION OF PREFERRED EMBODIMENTS OF THE INVENTION

Figure 1:
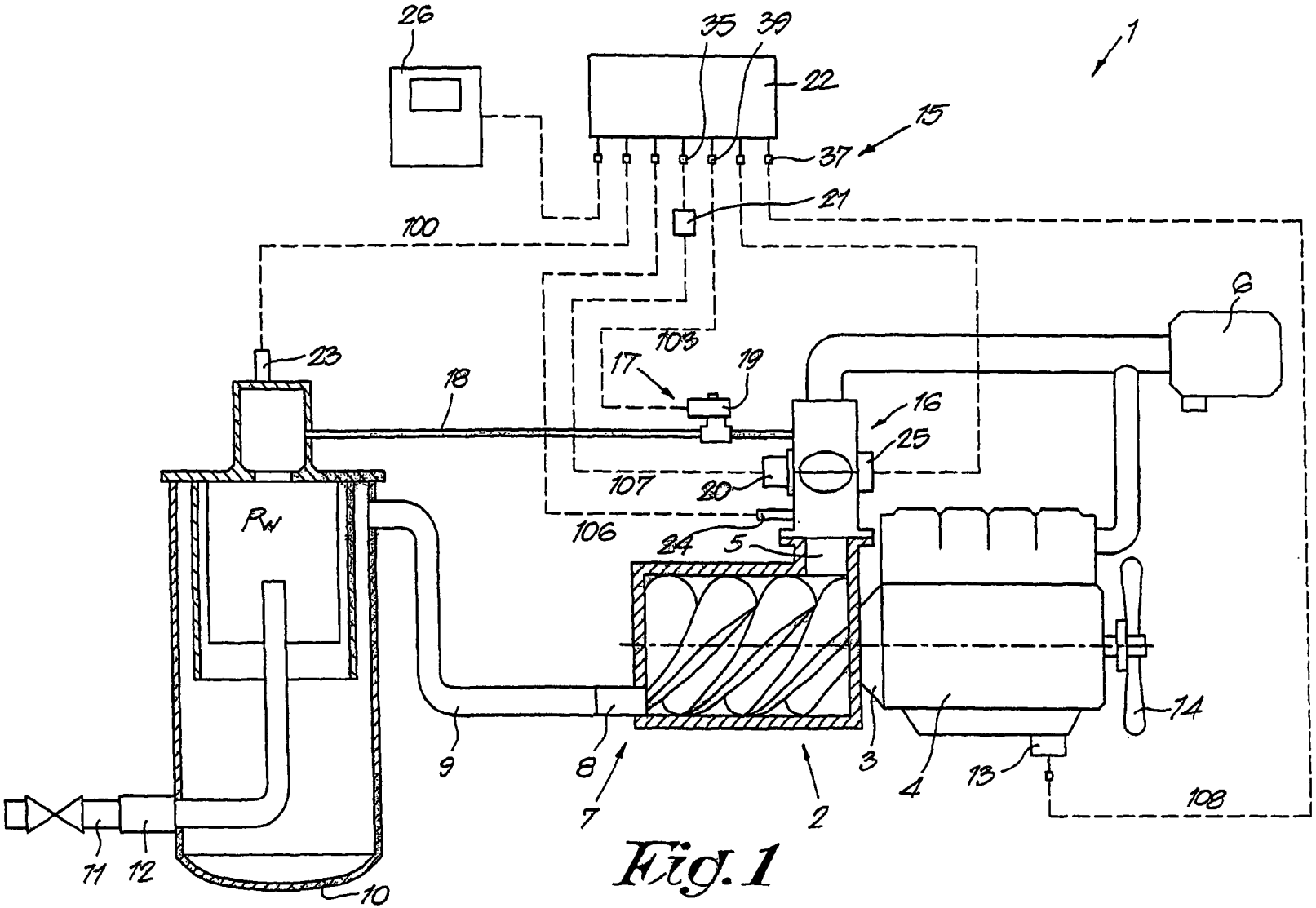
FIG. 1 schematically represents an oil-injected compressor installation which is provided with a device according to the invention.

FIG. 1 schematically represents a compressor installation 1 which is in this case made in the shape of an oil-injected screw compressor which is provided with a compressor element 2 that is driven via a transmission 3 by a motor 4 with an adjustable rotational speed.

The compressor element 2 is provided with an air inlet 5 for drawing in a gas to be compressed via an air filter 6 and with a compressed air outlet 7 which opens, via a non-return valve 8, in a pipe 9 that is connected to an oil separator 10 of a known type.

Via a compressed air pipe 11 which is connected to the above-mentioned oil separator 10 via a minimum pressure valve 12, compressed gas at a certain operating pressure Pw can be taken by compressed air users, such as for example to feed a compressed air network or the like.

The above-mentioned oil separator 10 is connected to an injection valve by means of an injection pipe, not represented in FIG. 1, which valve is provided on the compressor element 2 in order to inject the oil that has been separated from the compressed air in said compressor element 2 so as to lubricate and cool it.

The above-mentioned motor 4 is in this case a thermal motor which is provided with an electric starter motor, not represented in FIG. 1, and with an electronic control module 13 for controlling the rotational speed.

The above-mentioned motor 4 is also provided with a cooling fan 14.

Further, the compressor installation 1 is provided with a device 15 according to the invention for adjusting the operating pressure Pw of the compressor installation 1, which device 15 is provided with an electrically driven inlet valve 16 that is connected to the above-mentioned air inlet 5 and with a blow-off mechanism 17 which is in this case made in the shape of a blow-off pipe 18 which connects the oil separator 10 to the inlet valve 16 and which can be sealed by means of an electrically controllable blow-off valve 19.

In this case, the above-mentioned inlet valve 16 is made in the shape of a butterfly valve that is driven by means of a stepping motor 20 which can set the position of the inlet valve 16 incrementally between an open position and a closed position of the inlet valve 16.

The stepping motor 20 is, as is known, provided with an accompanying electronic stepping motor card 21 which preferably has a micro step modus.

The above-mentioned blow-off valve 19 is in this case made in the shape of a magnetic valve which can be engaged in two positions between a closed position and an open position.

According to the invention, the device 15 further comprises an electronic control unit 22 to which the above-mentioned control module 13 for the rotational speed of the motor, the above-mentioned inlet valve 16 and the blow-off valve 19 are connected to adjust the operating pressure Pw in the oil separator 10.

Further, also an operating pressure sensor 23 is connected to the control unit 22, which is provided on the above-mentioned oil separator 10, an inlet pressure sensor 24 mounted at the air inlet 5 and two proximity switches 25, of which only one is represented in FIG. 1 and which can detect the open and closed position of the butterfly valve.

Finally, also a control panel 26 is in this case connected to the control unit 22.

The working of a compressor installation 1 which is provided with a device 15 according to the invention for adjusting the operating pressure Pw of the compressor installation 1 is very simple and as follows.

The compressor installation 1 has three operating regimes: STARTUP, NOLOAD and LOAD/UNLOAD.

The compressor installation 1 always starts up in STARTUP modus, whereby the control unit 22 orders the stepping motor 20 to entirely close off the inlet valve 16 and whereby the blow-off valve 19 is opened.

Next, the thermal motor 4 is activated by the above-mentioned starter motor and the motor 4 is driven at a minimal rotational speed via the control module 13.

As the inlet valve 16 is entirely closed, the inlet pressure Pi prevailing at the air inlet 5 will be very low, as a result of which the motor load will drop and, consequently, the motor 4 can be easily started.

As soon as the thermal motor 4 has reached its full revs, the control unit 22 automatically switches from STARTUP modus to NOLOAD modus.

In NOLOAD modus, the control unit 22 sets the operating pressure Pw to a value that is lower than the opening pressure of the minimum pressure valve 12, such that the motor load is limited and the motor 4 can warm up in this manner.

The lower the operating pressure Pw in NOLOAD is selected, the lower the fuel consumption will be.

However, the operating pressure Pw must be selected high enough in order to be able to constantly inject sufficient oil from the oil separator 10 in the compressor element 2 via the above-mentioned injection pipe, and to thus avoid that the temperature at the compressed air outlet 7 of the compressor element 2 might get too high, since this causes an accelerated ageing of the compressor oil.

as soon as the thermal motor 4 has warmed up sufficiently, the control unit 22 can be switched, for example via the control panel 26, from NOLOAD modus to LOAD/UNLOAD modus.

In LOAD/UNLOAD, the control unit 22 adjusts the operating pressure Pw to a pressure that is higher than the opening pressure of the minimum pressure valve 12.

In this LOAD/UNLOAD modus, the compressor installation 1 can supply compressed air, whereby the operating pressure Pw can be set, via the control panel 26, at a value between the opening pressure of the minimum pressure valve 12 and the nominal operating pressure of the compressor installation 1.

When compressed air is being taken off, the compressor installation 1 will automatically switch to LOAD. When no compressed air is being taken off, the compressor installation 1 switches to UNLOAD.

If the user of the compressed air would like to make the compressor installation 1 work in a more economical manner than in UNLOAD, he/she can always set back the compressor installation 1 to NOLOAD via the control panel 26.

If the user of compressed air subsequently would like to take off compressed air again, he/she will have to wait somewhat longer in this case, however, until the operating pressure Pw has reached a value again which is higher than the opening pressure of the minimum pressure valve 12.

The working of the device 15 according to the invention in LOAD/UNLOAD modus will be explained hereafter by means of the technical control scheme in FIG. 2.

This scheme makes it clear that the control unit 22 has an operating pressure controller 27 and an inlet pressure controller 28 to that end which are preferably both made in the shape of a PID controller which is provided with a PID algorithm, represented by the blocks 29 and 30 respectively.

The above-mentioned operating pressure controller 27 calculates the difference between a desired operating pressure 100 and the operating pressure 101 measured by the operating pressure sensor 23.

In NOLOAD modus, the desired operating pressure 100 is a pre-programmed value in the control unit 22.

In LOAD/UNLOAD modus, however, the operator of the compressor installation can choose himself, for example via the control panel 26, between two different pressure adjustments by setting a selection parameter in a selection block 31 which contains an algorithm provided to that end.

A first possibility is that the desired operating pressure 100 can be set directly via the control panel 26 via an input block 32.

This desired operating pressure 100 can then have any value whatsoever between the nominal operating pressure of the compressor installation 1 and the opening pressure of the minimum pressure valve 12.

A second possibility that can be set via the selection block 31 is an operating pressure adjustment whereby the operating pressure Pw is automatically maximized by the control unit 22.

In this case, the value of the desired operating pressure 100 is a function of the outlet flow Qu of the compressor installation 1.

By the outlet flow Qu is meant the air mass flow in this case, flowing through the compressed air pipe 11.

Information about the outlet flow Qu is calculated in the control unit 22 in block 33 on the basis of the desired inlet flow 102 and the position of the blow-off valve 19 which is represented by signal 103.

By the inlet flow is meant the air mass flow which flows through the compressor element in this case.

Block 33 makes sure that the operating pressure Pw at all times stays under the design pressure of the oil separator 10.

The "overshoot" occurring in the operating pressure Pw in case of a sudden decrease of the outlet flow Qu, for example due to a sudden consumption decrease, increases in proportion to the volume of the outlet flow Qu at the time of the sudden consumption decrease.

According to the invention, in order to compensate for the "overshoot", taking into account what precedes, the desired operating pressure 100 is set at a lower value by the control unit 22 as the outlet flow Qu of the compressor installation 1 increases.

Next, the operating pressure controller 27 applies a PID algorithm 29 to the deviation of the operating pressure, i.e. the difference between the desired operating pressure 100 and the measured operating pressure Pw, corresponding to the signal 101.

The integrator in this algorithm makes sure that there is no static deviation between the desired operating pressure 100 and the measured operating pressure 101.

The optimal PID factors depend on the ambient pressure 104 which can be measured for example by an atmospheric pressure sensor which is not represented in the figures.

According to a preferred characteristic of a device 15 according to the invention, the ambient pressure 104 is not measured by means of such an atmospheric sensor however, but by means of the above-mentioned absolute inlet pressure sensor 24, right before the thermal motor 4 is started, since the inlet pressure Pi is at that time equal to the ambient pressure 104 as long as the compressor element 2 is idle.

The output signal of the operating pressure controller 27 represents the desired inlet flow 102 in percent. The inlet flow Qi is 100% when the rotational speed of the motor is maximal and the inlet valve 16 is entirely open. If the inlet valve was closed and would close off the air inlet entirely, such that a vacuum would prevail at the air inlet 5 of the compressor element 2, then the inlet flow Qi would be 0%.

The inlet flow Qi can be made equal to the desired inlet flow 102 by adjusting two parameters, namely the rotational speed of the compressor and the inlet pressure Pi.

Both parameters are proportional to the inlet flow Qi of the compressor element 2.

This is represented by the following formula 1:

$$\text{Inlet flow} = Cte * \text{rotational speed of the compressor} * \text{inlet pressure}$$

Adjusting the rotational speed of the compressor corresponds to adjusting the rotational speed of the thermal motor 4, whereby the control module 13 receives a desired value for the rotational speed of the motor from the control unit 22 and adjusts the rotational speed of the motor to this desired rotational speed.

The inlet pressure Pi of the compressor element 2 is adjusted by setting the position of the inlet valve 16 such that, when the inlet valve 16 is closed, the inlet pressure Pi decreases.

The above-mentioned inlet pressure controller 28 calculates the difference between a desired inlet pressure 105 and the actual inlet pressure Pi corresponding to the signal 106 and measured by the inlet pressure sensor 24.

The desired inlet pressure 105 is calculated in the calculation block 34 on the basis of the desired inlet flow 102 according to the following formula 2:

Desired inlet pressure=MIN[*Patm*;MAX(*PW*/maximal pressure ratio over the compressor element);(desired inlet flow/minimal rotational speed of the motor)**Patm*]

To the deviation of the inlet pressure Pi, i.e. the difference between the desired inlet pressure 105 and the measured inlet pressure 106, the above-mentioned PID algorithm 30 is then applied.

The outlet of the inlet pressure controller 28 also forms an outlet 35 for the control unit 22, via which the output signal 107 of the inlet pressure controller 28 is sent to the card 21 of the stepping motor 20, and which signal 107 determines the angular velocity at which the stepping motor 20 must turn, whereas the sign of the output signal 107 determines the sense of rotation of said motor 20.

In order to make the inlet flow Qi of the compressor element 2 decrease from 100% to 0%, for reasons of efficiency, the thermal motor 4 is first taken from its maximal rotational speed to its minimal rotational speed, whereby this minimal rotational speed typically amounts to some 70% of the maximal rotational speed.

For, according to formula 1, the inlet flow Qi of the compressor element 2 decreases in proportion to the rotational speed of the motor.

While the rotational speed of the motor is being adjusted, the inlet valve 16 stays entirely open.

Only when the thermal motor 4 is turning at its minimal rotational speed and the inlet flow Qi must decrease even further, will the inlet valve 16 be closed, while the motor 4 keeps turning at its minimal rotational speed.

From formula 1 can also be derived that the inlet flow Qi 10 is in proportion to the inlet pressure Pi of the compressor element 2.

Converting the desired inlet flow 102 to a desired rotational speed is done in the control unit 22 in calculation block 36 by applying formula 3:

Desired rotational speed of the motor [%]=MAX (minimal rotational speed of the motor [%];desired inlet flow [%])

These percentages must be calculated for example in relation to the maximal rotational speed, the maximal inlet flow respectively.

The desired value 108 of the rotational speed of the motor is transmitted via the outlet 37 of the control unit 22 to the control module 13 of the thermal motor 4.

It should be noted that, in practice, it is not desirable to reduce the inlet flow Qi to 0%, since a vacuum will prevail at the air inlet 5 of the compressor element 2 in this case, which vacuum 19 would in theory provide for an endless pressure ratio over the compressor element 2.

This pressure ratio over the compressor element 2 is defined as the quotient of the absolute operating pressure Pw and the absolute inlet pressure Pi of the compressor element 2.

If this pressure ratio gets too big, said compressor element 2 will be exposed to heavy vibrations, resulting in a short life span.

Also, the pressure ratio over the compressor element 2 must have an upper limit.

The admitted maximum pressure ratio over the compressor element 2 is a machine constant.

As long as the motor 4 is turning, there will always be a certain inlet flow Qi flowing to the oil separator 10.

If there is no compressed air take-off and, consequently, there is no outlet flow Qu, the above-mentioned blow-off mechanism 17 makes sure that the exhaust flow Qb, which flows from the oil separator 10 to the air inlet 5 again, is equal to the inlet flow Qi, such that the operating pressure Pw in the oil separator 10 will not continue rising.

The exhaust flow Qb hereby is the air mass flow flowing through the blow-off valve 19.

Figure 2:
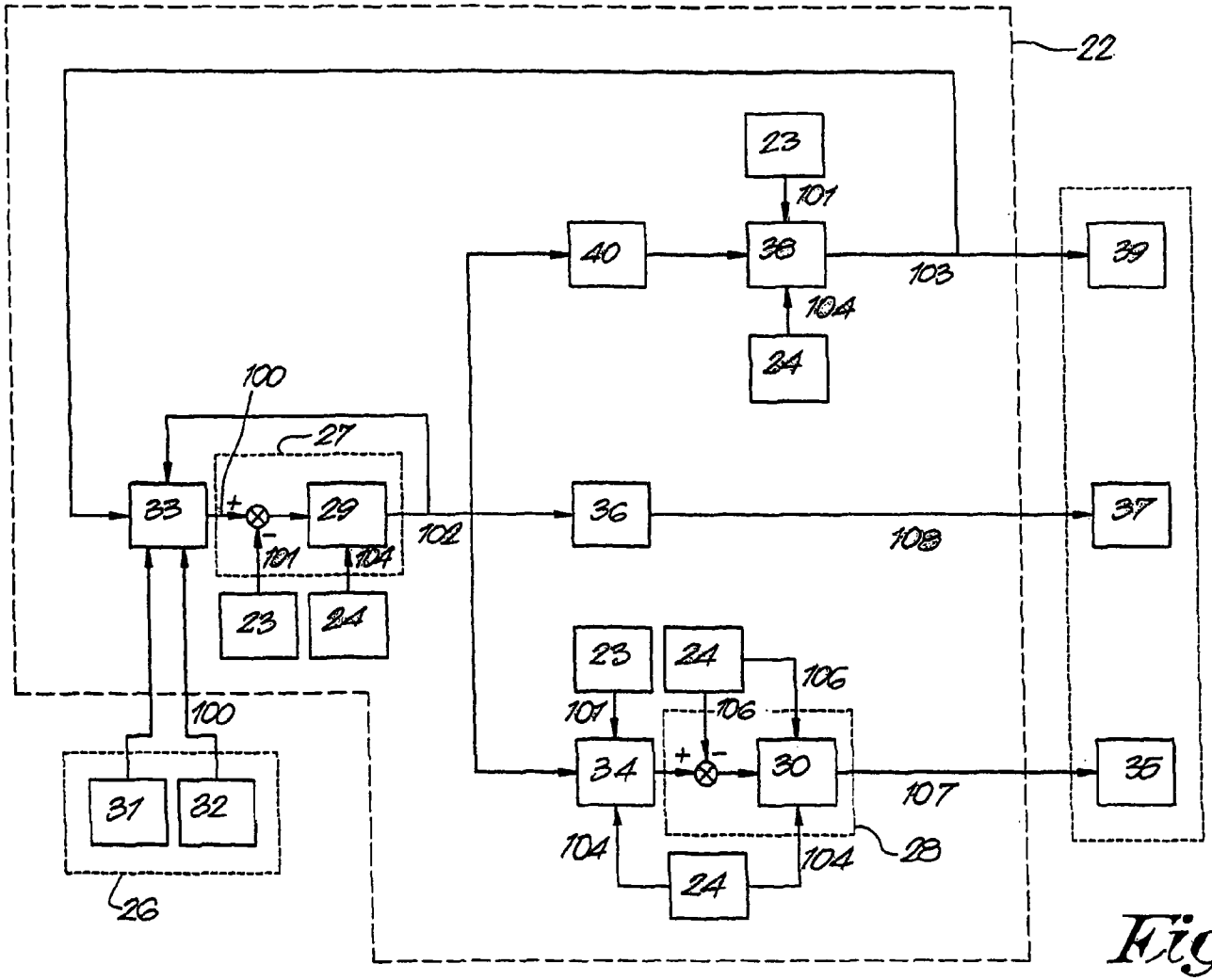
FIG. 2 represents a technical control scheme of a control system according to the invention.

In the preferred embodiment of a device 15 according to the invention, which device 15 is represented in FIG. 2, the exhaust flow Qb ends up on the inlet side of the inlet valve 16, i.e. on the side of the inlet valve 16 which is connected to the air filter 6.

As the above-mentioned blow-off valve 19 of the blow-off mechanism 17 can only be engaged in two positions between a closed position and an open position, only a discontinuous adjustment of the exhaust flow Qb will be possible.

The control unit 22 is preferably provided with a memory, not represented in the figures, to store the actual position of the blow-off valve 19 in.

Figure 3:
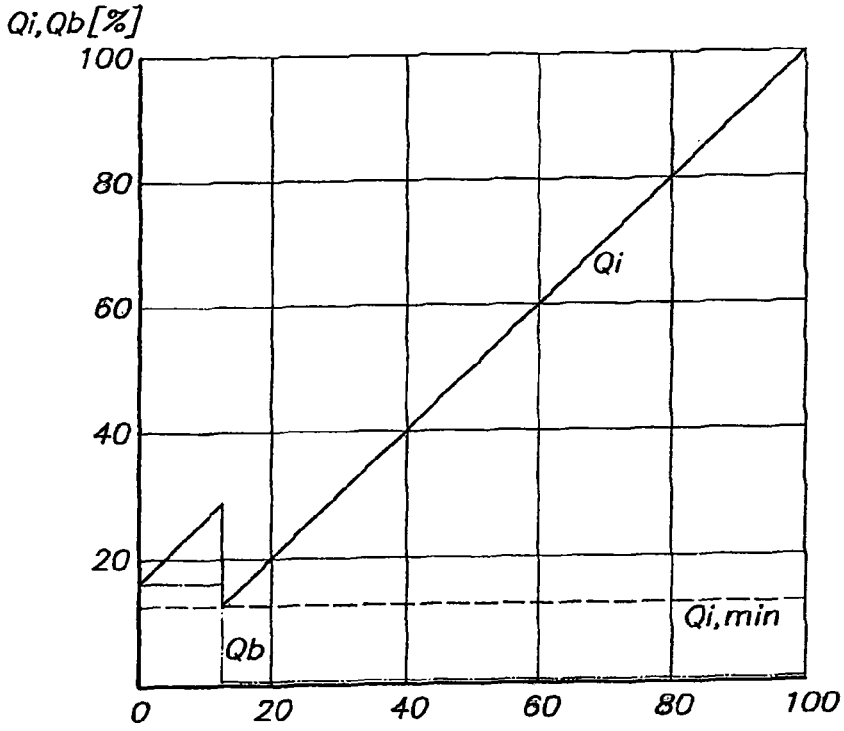
FIG. 3 represents an operation graph of the device in FIG. 1.

The principle of the discontinuous blow-off adjustment is represented in FIG. 3, in which the inlet flow Qi is represented as a full line as a function of the outlet flow Qu, represented by the horizontal axis.

In the graph are also represented the exhaust flow Qb as a dot and dash line, and the minimal inlet flow Qi,min as a dash line, both as a function of the outlet flow Qu of the compressor element 2.

This figure is made for the stationary condition. It should be noted that the minimal inlet flow Qi,min and the exhaust flow Qb are not fixed values, however, but that they strongly depend on many factors such as the type of compressor installation 1, the operating pressure Pw and the like.

In the stationary condition, formula 4 applies:

Inlet flow *Qi*=outlet flow *Qu*+exhaust flow *Qb*

With a maximal inlet flow of 100%, the blow-off valve 19 is closed and consequently there will be no exhaust flow Qb, such that according to formula 4, the inlet flow Qi is equally large as the outlet flow Qu of the compressor element 2.

If the compressed air user makes the outlet flow Qu decrease, the operating pressure controller 27 will make the inlet flow Qi decrease as well to the minimal inlet pressure, and thus the minimal inlet flow Qi,min will be reached.

The minimal inlet flow Qi,min is the inlet flow Qi that is reached at a minimal rotational speed of the motor and a maximal pressure ratio over the compressor element 2.

At that instant, the blow-off valve 19 is opened.

When the desired inlet flow Qi is thus smaller than the minimal inlet flow Qi,min, the control unit will open this magnetic valve or keep it open.

The opening of the blow-off valve 19 causes a pressure drop in the oil separator 10 to which the operating pressure controller 27 will react by raising the inlet flow Qi until it is equal to the sum of the outlet flow Qu and the exhaust flow Qb.

When no compressed air is being taken and, consequently, there is no outlet flow Qu, the blow-off valve 19 is open.

According to formula 4, the inlet flow Qi is in this case equal to the exhaust flow Qb.

When the outlet flow Qu increases in this case as a result of a larger compressed air take-off, the operating pressure controller 27 will make the inlet flow Qi increase as well until the inlet flow Qi becomes equal to the sum of the minimal inlet flow Qi,min and the exhaust flow Qb.

At that instant, the blow-off valve 19 is closed.

When the desired inlet flow 102 is thus larger than the sum of the minimal inlet flow Qi,min and the exhaust flow Qb, the control unit 22 will close said blow-off valve 19 or keep it closed.

Closing off the blow-off pipe 18 results in an increase of pressure in the oil separator 10 to which the operating pressure controller 27 reacts by reducing the inlet flow 23 Qi until it is equal to the outlet flow Qu.

When the desired inlet flow 102 is larger than the minimal inlet flow Qi,min and smaller than the sum of the minimal inlet flow Qi,min and the exhaust flow Qb, the position of the blow-off valve 19 shall remain unchanged.

The width of passage of the blow-off valve 19 must be dimensioned well in order to avoid that, due to a too small dimension, a static deviation would be created between the measured operating pressure Pw and the desired operating pressure 100 while the pressure ratio over the compressor element 2 is maximal.

On the other hand, the width of passage of the blow-off valve 19 should not be too large either, since a too large exhaust flow Qb is disadvantageous to the efficiency of the compressor installation 1.

Preferably, the size of the width of passage of the blow-off valve 19 is selected such that, in NOLOAD, the maximum pressure ratio over the compressor element 2 is reached.

This optimal width of passage can be calculated on the basis of formula 5:

$$A = Cte * \frac{B * C}{D * E} * \sqrt{F}$$

In which:

A=the optimized width of passage of the blow-off valve [$m^2$];

B=the swept volume of the compressor element [$m^3$/tr]; this is no constant, but a parameter which depends on a number of a factors such as the rotational speed of the male rotor of the compressor element, the operating pressure Pw, the inlet pressure Pi and the like;

C=the minimal rotational speed of the male rotor [tris];

D=the maximal pressure ratio over the compressor element 2;

E=the air temperature at the inlet of the compressor element 2 [K];

F=the air temperature at the inlet of the width of passage [K].

The parameters B and C of the above-mentioned formula 5 strongly depend on the type of compressor installation 1, such that the optimal width of passage A is different for each compressor installation 1.

For each type of compressor installation 1, the aforesaid function is maximized to thus calculate the optimal width of passage A of the blow-off valve whereby, under no environmental and machine circumstances whatsoever, the measured operating pressure Pw remains higher than the desired operating pressure 100.

This "worst-case" scenario does not often occur in practice, such that in most situations, the width of passage A of the blow-off valve 19 is dimensioned too large.

The difference between the exhaust flow Qb and the minimal inlet flow Qi,min is called the safety factor, which safety factor is equal to 0 in the "worst-case" scenario.

Thus, the condition for closing the blow-off valve 19 thus becomes:

Desired inlet flow>2*minimal inlet flow+safety factor.

The conditions for opening and closing the blow-off valve 19 are programmed in the control unit, i.e. in the calculation block 38 which is connected to the operating pressure sensor 23 and to the inlet pressure sensor 24, which are necessary to calculate the minimal inlet flow Qi,min and which represent the measured operating pressure 101 and the ambient pressure 104 respectively.

The output signal 103 of calculation block 38 is a signal which, via the outlet 39 of the control unit 22, opens or closes the blow-off valve 19.

Further, a low-pass filter 40 is preferably placed in the control unit 22 in front of the calculation block 38, i.e. between the operating pressure controller 27 and the calculation block 38, so as to obtain a more stable control system.

As with the known devices 15 that work pneumatically, the selection of the widths of passage of the blow-off valves 19 is restricted and not every compressor installation 1 will be able to reach the maximal pressure ratio over the compressor element 2 in NOLOAD.

In UNLOAD, the maximal pressure ratio over the compressor element 2 is maintained, irrespective of the operating pressure Pw.

If, for example, the inlet pressure Pi is doubled, then also the inlet flow Qi will be doubled and the operating pressure Pw will keep rising until a new stationary condition has been reached.

The exhaust flow Qb should then be as large as the inlet flow Qi and it is doubled as well.

We notice that, when the exhaust flow Qb is doubled, the absolute operating pressure Pw is doubled as well, such that the pressure ratio over the compressor element 2 remains constant, since both the inlet pressure Pi and the operating pressure Pw have doubled.

Thanks to the selection of the butterfly valve as an inlet valve 16, only a limited steering capacity is required in comparison with the piston/inlet valve that is applied in the conventional pneumatic control devices, which is necessary to keep the cost of the electric actuator, which in this case consists of the stepping motor 20, as low as possible.

Another advantage of the use of such a butterfly valve is that, thanks to its design, it has only limited inlet losses in comparison with the piston/inlet valve of a pneumatic control device that is traditionally applied.

For, in such a piston/inlet valve, the air first passes a number of bends before it finally reaches the air inlet, what causes a considerable inlet loss.

An additional advantage of the butterfly valve is its compactness.

Figure 4:
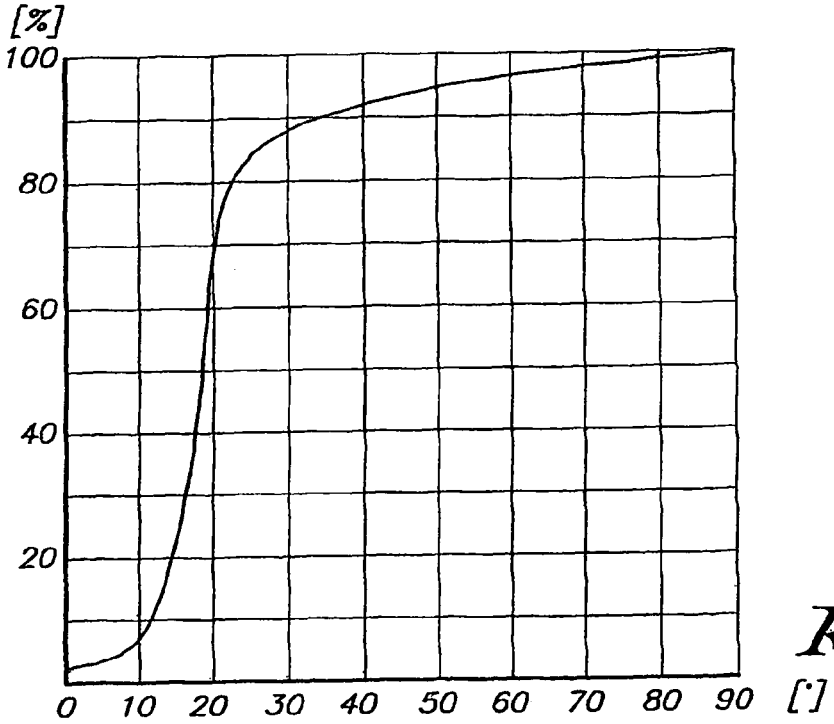
FIG. 4 represents the working curve of an inlet valve that is part of a device according to FIG. 1.

Of importance to the dynamics of the control system is the operating characteristic that is typical of the inlet valve 16 and that is schematically represented in FIG. 4.

This operating characteristic represents the pressure ratio of the inlet valve as a function of the position of the inlet valve.

By pressure ratio of the inlet valve is meant here the ratio between the absolute pressure following the inlet valve 16 at the air inlet 5 of the compressor element 2 and the absolute pressure at the inlet side of the inlet valve 16.

An inlet valve position of 0° stands for a closed butterfly valve, an inlet valve position of 90° stands for an entirely opened butterfly valve.

The form of the operating characteristic, which is typically not linear, depends on the design and dimensions of the butterfly valve, as well as the volumetric flow of the compressor element 2.

A larger diameter of the butterfly valve and a larger volumetric flow make the operational characteristic less linear.

The operating characteristic shows that, in the right half of the graph, the inlet pressure Pi decreases only little with a lowering inlet valve position.

Also, in this whole area, changing the position of the inlet valve has little influence on the inlet flow Qi.

Only in the left half of the operating characteristic will the inlet pressure Pi and thus the inlet flow Qi) significantly change when the position of the inlet valve is altered.

In order to adjust the position of the inlet valve, use is made in this case of the above-mentioned stepping motor 20 whose turns are reinforced by the above-mentioned electronic stepping motor card 21.

This stepping motor card 21 receives, via the above-mentioned electronic stepping motor card 21, a low capacity control signal from the control unit 22.

An advantage of the use of such a stepping motor 20 is that this type of electric motor can already develop its maximum torque at standstill, which is necessary since the asymmetrical air flow through the inlet valve 16 creates a load torque on the shaft of the butterfly valve.

Naturally, the hold torque of the stepping motor 20 must be larger than the load torque to keep the butterfly valve in the desired position.

An additional advantage of the use of such a stepping motor is the relatively low cost price.

A characteristic of the stepping motor 20 is its stepping angle in full stepping modus of the stepping motor card 21.

In a preferred embodiment of a device according to the invention, the stepping motor 20 makes two hundred steps per revolution, which corresponds to a stepping angle of 1.8°.

From the operating characteristic in FIG. 4 follows that these 1.8° in the most critical situation correspond to an inlet pressure difference of some 15%, which entails a great risk of instability.

This problem is solved according to the invention by making use of the above-mentioned electronic stepping motor card 21 which has a micro step modus, whereby the stepping angle of the full stepping modus is divided in a number of smaller micro steps.

When, for example, eight micro steps per stepping angle are selected, a positioning resolution of 0.225° is already obtained.

Turning back to the operating characteristic of FIG. 4, this appears to correspond to only some 2% inlet pressure difference in the most critical situation, which is acceptable.

As the operating characteristic of the inlet valve is non-linear, a non-linear control system is obtained.

Consequently, when the reinforcement K of the inlet pressure controller 28 is optimized for the left half of the operating characteristic, the stepping motor 20 will not be fast enough in the right part of the operating characteristic, as a result of which the operating pressure changes become inadmissibly big when switching between LOAD and UNLOAD.

Vice versa, if the reinforcement K of the inlet pressure controller 28 is optimized for the right half of the operating characteristic, the stepping motor will react much too strongly in the left part of the operating characteristic, resulting in an unstable control system.

In order to solve this problem, the inlet pressure controller 28 is provided with what is called 'gain scheduling' whereby the reinforcement K, which provides for the proportional action of the PID algorithm 30 of the inlet pressure controller 28, is adjusted as well when the position of the inlet valve 16 changes.

The inlet valve position can be measured, for example, by means of a position recorder such as an encoder.

Since such an encoder is usually relatively expensive, a preferred characteristic of the invention is to let the selection of the reinforcement K of the inlet pressure controller 28 not depend on the position of the inlet valve T6, but on the pressure ratio over the inlet valve 16.

For, statically speaking, the position of the inlet valve 16 can be derived from the inlet valve pressure ratio if the operating characteristic is well known.

Moreover, from a dynamic point of view, there is only a small time constant between the position of the inlet valve 16 and the pressure ratio over the inlet valve 16 as a result of the relatively small volume between the butterfly valve and the air inlet and the relatively high volume flow of the compressor element 2.

No extra sensors are required to measure this inlet pressure, since the inlet pressure sensor 24 is already present to check the pressure ratio over the compressor element 2.

Actually, the range of the pressure ratio of the inlet valve 16 is divided in a finite number of intervals.

Within every interval, the reinforcement K of the inlet pressure controller 28 has a constant value that is calculated for each individual interval as the opposite of the average reinforcement of the operating characteristic in the interval concerned, multiplied by a constant value.

This can be expressed by formula 6:

$$K = \frac{1}{Kgem.} * Cte'$$

The constant value Cte' is hereby selected such that the dynamics of the inlet pressure control are optimal in the inlet pressure interval with the lowest reinforcement K.

The reinforcement K has an upper limit, since it might otherwise acquire a too large value near the utmost valve positions at 0° and 90°.

Figure 5:
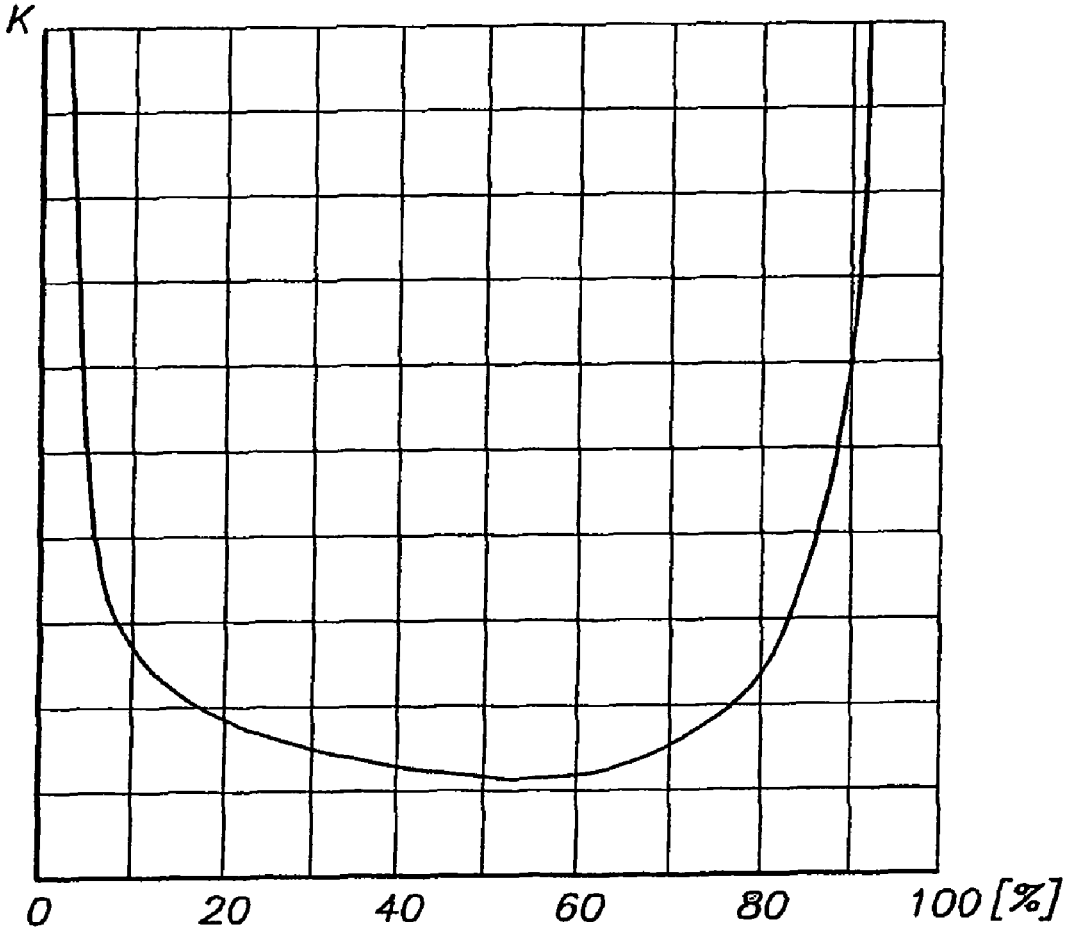
FIG. 5 represents the reinforcement curve of the inlet pressure controller.

FIG. 5 represents an example of 'gain scheduling', whereby the reinforcement K is represented in the ordinate as a function of the pressure ratio of the inlet valve 16 in the abscissa, namely for a large number of intervals of the inlet valve's pressure ratio.

Thus, by means of 'gain scheduling' is obtained a more linear control system with better dynamical qualities.

For the good working order of a device 15 according to the invention for adjusting the operating pressure Pw of an oil-injected compressor installation 1, it is important that the position of the inlet valve 16 is at all times more than 0° and less than 90°.

This can be realised for example by providing two mechanical stops which stop the valve body as it approaches the utmost position.

However, the use of such mechanical stops may provoke serious impacts, which is disadvantageous to the life of the components.

Another possibility consists in making use of sensors which detect the utmost valve positions of the inlet valve 16, which sensors in this case are proximity switches 25.

The control unit 22 will then make sure not to direct the stepping motor 20 any further in the direction of the utmost valve position concerned.

When the compressor installation 1 is switched off, it will first be switched to NOLOAD modus for a predetermined time by the control unit 22, so that the thermal motor 4 is minimally loaded, whereas the fan 14 keeps turning at the minimum rotational speed and the compressor installation 1 can cool down somewhat before the thermal motor 4 is actually stopped.

The present invention is by no means limited to the embodiments given as an example and represented in the accompanying drawings; on the contrary, such a device according to the invention for adjusting the operating pressure of an oil-injected compressor installation can be made in all sorts of shapes and dimensions while still remaining within the scope of the invention.

The invention claimed is:

1. Device for adjusting operating pressure of an oil-injected compressor installation including a compressor element driven by a motor having an adjustable rotational speed, controlled by a control module, and including an air inlet and a compressed air outlet to which is connected an oil separator connected to a compressed air pipe supplying compressed gas, said device comprising:

a controlled inlet valve connected to the air inlet and a blow-off mechanism connected to a blow-off pipe which connects the oil separator to the inlet valve and is closeable by a blow-off valve, said inlet valve, blow-off valve and control module comprising electrically controllable components connected to an electronic control unit and arranged to adjust the operating pressure in the oil separator, said operating pressure being measured by an operating pressure sensor that is connected to the electronic control unit;

wherein said inlet valve comprises a butterfly valve driven by a stepping motor having an accompanying electronic stepping motor card;

wherein said electronic stepping motor card includes a micro step modus;

wherein said control unit includes an operating pressure controller configured as a PID controller that generates an output signal representing a desired inlet flow of the compressor element to adjust the rotational speed of the motor, the inlet pressure at the air inlet and the exhaust flow;

wherein the control unit also includes an inlet pressure controller configured as a PID controller that applies a PID algorithm using a deviation of the inlet pressure to generate a signal used to determine an angular velocity of the stepping motor, wherein a reinforcement used in the PID algorithm is adjusted to provide a proportional action for the PID controller responsive to a deviation of the inlet pressure, wherein the reinforcement is a function of the position of the inlet valve or of the relation between the absolute pressure following the inlet valve at the air inlet of the compressor element and the absolute pressure on the inlet side of the inlet valve.

2. Device according to claim 1, wherein the blow-off valve comprises a magnetic valve that is moveable between a closed and an open position.

3. Device according to claim 2, wherein the control unit includes a memory capable of storing the position of the magnetic valve.

4. Device according to claim 1, wherein the control unit includes a calculation block containing an algorithm which opens the blow-off valve or keeps it open when the desired inlet flow is smaller than the minimal inlet flow that is reached at a minimal rotational speed of the motor and a maximal pressure ratio over the compressor element; wherein the control unit is arranged to close the blow-off valve or keeps it closed when the desired inlet flow is larger than the sum of the minimal inlet flow and the exhaust flow; and wherein the control unit is arranged so that the position of the blow-off valve does not change when the minimal inlet flow is smaller than the desired inlet flow, which in turn is smaller than the sum of the minimal inlet flow and the exhaust flow.

5. Device according to claim 4, wherein the control unit, between the operating pressure controller and the calculation block, includes a low-pass filter.

6. Device according to claim 1, wherein the control unit includes a selection block containing an algorithm enabling direct adjustment of the operating pressure in a first selection position, and adjustment of the operating pressure in a second selection position, wherein the operating pressure is automatically maximized to an operating pressure value between the nominal operating pressure and the design pressure of the compressor installation, so that the peak value of the operating pressure, in the event of a transition from a loaded to an unloaded compressor installation, always is maintained below the design pressure of the compressor installation.

7. Device according to claim 1, including a control panel configured to enable adjustment of the desired operating pressure in the control unit.

8. Device according to claim 1, including a remote control arranged to adjust the operating pressure in the control unit.

9. Device according to claim 1, wherein the operating pressure controller includes an algorithm arranged to adjust the PID-factors of the operating pressure controller to ambient pressure.

10. Device according to claim 1, wherein the control unit includes a STARTUP modus according to which the inlet valve is entirely closed, the blow-off valve is opened and the motor is started only then and wherein, as soon as the motor has reached its full speed, the control unit automatically switches from STARTUP modus to a NOLOAD modus, so that the operating pressure is adjusted to a value which is lower than the opening pressure of the minimum pressure valve by the control unit.

11. Device according to claim 1, including proximity switches on the inlet valve which are arranged to detect when a valve body in said inlet valve approaches end positions and transmit information regarding such end positions to the control unit.

12. A method for adjusting operating pressure of an oil-injected compressor installation comprising a compressor element driven by a motor having an adjustable rotational speed, a control module that controls the compressor element, an air inlet, a compressed air outlet connected to an oil separator which is connected to a compressed air pipe supplying compressed gas, and a controlled inlet valve connected to the air inlet and a blow-off mechanism connected to a blow-off pipe which connects the oil separator to the inlet valve and is closeable by a blow-off valve, said method comprising the steps:

measuring an operating pressure using an operating pressure sensor connected to an electronic control unit;

controlling the operating pressure in the oil separator by adjusting the inlet valve, blow-off valve, and control module using the electronic control unit, wherein said electronic control unit comprises at least an operating pressure controller and an inlet pressure controller;

regulating the rotational speed of the motor, the inlet pressure at the air inlet and the exhaust flow using the operating pressure controller, said operating pressure controller generating an output signal representing a desired inlet flow of the compressor element, wherein the operating pressure controller is configured as a PID controller;

applying a PID algorithm using the inlet pressure controller to a deviation of the inlet pressure to generate a signal used to determine an angular velocity of a stepping motor, wherein said inlet pressure controller is configured as a PID controller; and wherein the signal is determined by adjusting a reinforcement of the PID algorithm to provide a proportional action for the pressure controller, wherein the reinforcement is a function of the position of the inlet valve or of the relation between the absolute pressure following the inlet valve at the air inlet of the compressor element and the absolute pressure on the inlet side of the inlet valve, and wherein said inlet valve is a butterfly valve driven by the stepping motor having an accompanying electronic stepping motor card including a micro step modus.

* * * * *